US005565042A

United States Patent [19]

Sakurai et al.

[11] Patent Number: 5,565,042

[45] Date of Patent: Oct. 15, 1996

[54] BLACK CHROMATE SOLUTION

[75] Inventors: Hitoshi Sakurai; Seiji Kishikawa; Tomitaka Yamamoto; Tadahiro Itoh, all of Tokyo, Japan

[73] Assignee: Dipsol Chemicals Co., Ltd., Tokyo, Japan

[21] Appl. No.: 562,149

[22] Filed: Nov. 22, 1995

[30] Foreign Application Priority Data

Dec. 27, 1994 [JP] Japan ..... 94-324890

[51] Int. Cl.[6] ..... C23C 22/26

[52] U.S. Cl. ..... 148/266

[58] Field of Search ..... 148/266

[56] References Cited

U.S. PATENT DOCUMENTS

| | | | |
|---|---|---|---|
| 2,483,510 | 10/1949 | Starocle | 148/260 |
| 5,080,733 | 1/1992 | Deresh | 148/266 |

FOREIGN PATENT DOCUMENTS

| | | |
|---|---|---|
| 1-168875 | 7/1989 | Japan . |
| 4-56782 | 2/1992 | Japan . |
| 7-166367 | 6/1995 | Japan . |

*Primary Examiner*—Sam Silverberg
*Attorney, Agent, or Firm*—Oblon, Spivak, McClelland, Maier & Neustadt, P.C.

[57] ABSTRACT

A chemically stable black chromate solution capable of forming an anticorrosive black chromate film on a Zn-Ni alloy plating is provided, the components being easily soluble in the solution. The black chromate solution comprises 1 to 50 g/l of hexavalent chromium; 1 to 50 g/l of sulfate ion; 0.05 to 1.0 g/l of soluble silver; 0.5 to 100 g/l of a sulfonated carboxylic acid selected from the group consisting of sulfo-aromatic carboxylic acids having 7 to 15 carbon atoms, sulfonated aliphatic dicarboxylic acids having 3 to 10 carbon atoms and salts thereof; and a balance of water, the solution having a pH of 0.5 to 2.5.

8 Claims, No Drawings

BLACK CHROMATE SOLUTION

BACKGROUND OF THE INVENTION

The present invention relates to a black chromate solution used for forming a highly anticorrosive black chromate film on a Zn plate, Zn-plating, Zn alloy plating such as Zn-Ni alloy plating, and a method of forming a chromate film thereon, especially on a Zn-Ni alloy.

The treatment of a zinc plating with a chromate is still widely employed for the purposes of decoration and anticorrosion in the fields of automobiles, domestic electric appliances, etc.

However, the plating thus formed has defects that the corrosion resistance thereof is yet insufficient under severe conditions when it is kept in an overheated engine room or on an icy road, when it is exposed to a chemical used for removing snow when it snows, or when it is damaged by salty sea breezes. Under these conditions, various Zn alloy platings capable of forming a plating film having a corrosion resistance far superior to that of a zinc plating were investigated and developed. Among them, a high corrosion resistance of a Zn-Ni alloy attracts attention mainly in the automobile field. As a monotony tint and a high grade are inclined to be liked by the users recently, a substance for blacking the Zn-Ni alloy plating is demanded. In addition, there is investigated a black chromate which does not impair the properties of the Zn-Ni alloy plating and further a chemically stable black chromate solution useful when the Ni deposition rate is in the practical range of 3 to 12% by weight. The best technique comprises adding an aliphatic carboxylic acid to an ordinary black chromate solution for treating Zn to form a black chromate film on the Zn-Ni alloy plating.

However, the process wherein formic acid, citric acid or tartaric acid is used as the aliphatic carboxylic acid has a problem that the treating solution is impractical, since the solution is chemically unstable and the ingredients in the solution tend to be decomposed. The process wherein succinic acid is used has a problem that the appearance thereof is yet insufficient in the blackness and gloss, though the treating solution is chemically stable.

SUMMARY OF THE INVENTION

A primary object of the present invention is to provide a chemically stable black chromate solution capable of forming a highly anticorrosive black chromate film on a Zn-plating, Zn alloy plating and the like, the components being easily soluble in the solution.

Another object of the present invention is to provide a method of forming a black chromate film on a Zn-Ni alloy.

These and other objects of the present invention will be apparent from the following description and examples.

The present invention has been completed on the basis of a finding that the above-described problems can be efficiently solved by using a sulfo-aromatic carboxylic acid, its salt, sulfonated aliphatic dicarboxylic acid or its salt as the organic acid to be contained in the black chromate solution.

Namely, the present invention provides a black chromate solution which comprises hexavalent chromium; sulfate ion; soluble silver; and a sulfonated carboxylic acid selected from the group consisting of sulfo-aromatic carboxylic acids, sulfonated aliphatic dicarboxylic acids and salts thereof; and water.

The present invention further provides a method of forming a black chromate film on a Zn-Ni alloy plating which comprises immersing the Zn-Ni alloy plating into a black chromate solution comprising hexavalent chromium; sulfate ion; soluble silver; and a sulfonated carboxylic acid selected from the group consisting of sulfo-aromatic carboxylic acids, sulfonated aliphatic dicarboxylic acids and salts thereof; and water.

DESCRIPTION OF THE PREFERRED EMBODIMENTS

Examples of the sulfo-aromatic carboxylic acids usable in the present invention include those having 7 to 15 carbon atoms such as sulfobenzoic acid, sulfophthalic acid, sulfoterephthalic acid and sulfonated naphthalic acid. The sulfonated aliphatic dicarboxylic acids include, for example, those having 3 to 10 carbon atoms such as sulfonated succinic acid and adipic acid. The salt of them may be any of those soluble in the black chromate solution. Examples of the salts include sodium and ammonium salts.

The sulfonated carboxylic acids can be used either singly or in the form of a mixture of two or more of them in the present invention. Although the amount of the sulfonated carboxylic acid is not particularly limited, it is preferable that the concentration thereof in the black chromate solution be 0.5 to 100 g/l, more preferably 5 to 40 g/l.

The black chromate solution of the present invention contains hexavalent chromium, sulfate ion ($SO_4^{2+}$) and soluble silver. Compounds usable as the hexavalent chromium source are, for example, chromic acid, salts thereof, bichromic acid, salts thereof and mixtures of two or more of them. The compounds for forming the sulfate ion include sulfuric acid, salts thereof (such as sodium, potassium and ammonium salts thereof) and mixtures of two or more of them. The compounds for forming the soluble silver include, for example, silver sulfate.

The black chromate solution of the present invention can contain these components in optional amounts. Preferably, it contains 1 to 50 g/l of hexavalent chromium, 1 to 50 g/l of sulfate ion, 0.05 to 1.0 g/l of soluble silver and 0.5 to 100 g/l of the sulfonated carboxylic acid. The pH of the black chromate solution of the present invention is preferably controlled in the range of 0.5 to 2.5.

The black chromate solution of the present invention contains water as the balance. Further, amines such as methylamine, ethylenediamine and diethylenetriamine can be incorporated into the solution.

The black chromate solution of the present invention is effective in forming a black chromate film on a Zn-Ni alloy plating having any composition. It exhibits an excellent effect particularly when a black chromate film is formed on a Zn-Ni alloy plating having a Ni deposition rate of not higher than 15% by weight, preferably in the range of 3 to 12% by weight. Namely, when the black chromate film is to be conventionally formed on the Zn-Ni alloy plating of this composition, the formed film, even when it can be obtained, is not uniform and the corrosion resistance is seriously impaired, since the pH is rapidly increased at the boundary (interface) between them. On the contrary, in the present invention wherein the specified sulfonated carboxylic acid is used, the interface formed by the chromate film is exposed to a stable pH atmosphere to make the stable formation of the film possible. Thus, the high anticorrosive function of the Zn-Ni alloy plating is not impaired, and further, more excellent anticorrosive effect can be obtained.

The treatment with the black chromate is usually conducted by immersing the substrate to be treated in the black chromate solution of the present invention. For example, the substrate is immersed in the solution having a temperature of 15 to 50 ° C. for 30 to 300 seconds, preferably 30 to 180 seconds to form a black chromate film having a thickness of 0.5 to 3 μm, preferably 1 to 2 μm.

Thus, in a preferred embodiment, the substrate is plated with a Zn-Ni alloy (Ni deposition rate: preferably 3 to 12% by weight) (thickness of the plating: at least 2 μm, preferably 5 to 20 μm) and then the black chromate film is formed by the above-described process.

By the process of the present invention, the black chromate film can be uniformly formed on the Zn-Ni alloy plating. Since the specified sulfonated carboxylic acid exhibits a buffer action under chromic acid-acidic conditions in a pH range of 1 to 3.5, the uniform black chromate film can be formed and, as a result, the corrosion resistance can be improved and excellent stability can be obtained.

Therefore, the products obtained by forming the black chromate film by the process of the present invention can be widely used in the fields of automobiles, domestic electric appliances, building materials and parts, etc.

The following Examples will further illustrate the present invention.

EXAMPLE 1

A steel plate plated with a Zn-Ni alloy (Ni content: 3, 5, 7, 9, 12 or 15% by weight) in a thickness of 8 μm was immersed in a chromate solution having a composition given below at 25 ° C. for 90 seconds. As a result, an excellent black chromate film was formed when the Ni content was 3, 5, 7, 9 or 12% and, on the contrary, a black chromate film having an interference color was obtained when the Ni content was 15%.

| | |
|---|---|
| $CrO_3$ | 10 g/l |
| $Na_2SO_4$ | 15 g/l |
| $AgNO_3$ | 0.8 g/l |
| sulfonaphthalic acid | 7 g/l |
| water | balance |
| pH | 1.3 (adjusted with NaOH). |

EXAMPLE 2

A Zn-Ni plating having a thickness of 6 μm and Ni content of 6% was treated with a chromate solution having the following composition at 20° C. for 3 minutes to obtain a uniform black chromate film:

| | |
|---|---|
| $CrO_3$ | 5 g/l |
| $Na_2Cr_2O_7.2H_2O$ | 20 g/l |
| $Na_2SO_4$ | 25 g/l |
| $H_2SO_4$ | 2 g/l |
| $Ag_2SO_4$ | 0.5 g/l |
| sulfoterephthalic acid | 3 g/l |
| water | balance |
| pH | 1.6 (adjusted with NaOH). |

EXAMPLE 3

A Zn-Ni plating having a thickness of 10 μm and Ni content of 8% was treated with a chromate solution having the following composition at 25 ° C. for 2 minutes to obtain a uniform black chromate film:

| | |
|---|---|
| $Na_2Cr_2O_7.2H_2O$ | 15 g/l |
| $H_2SO_4$ | 5 g/l |
| $Ag_2SO_4$ | 0.5 g/l |
| sodium salt of sulfonated adipic acid | 15 g/l |
| water | balance |
| pH | 1.5 (adjusted with NaOH). |

Comparative Example 1

A steel plate was plated with Zn to form a plating film having 8 μm thickness. The plate was then treated with a black chromate solution ZB-547 (a product provided by Dipsol Chemical Co., Ltd.) for Zn plating at 25 ° C. for 1 minute.

Table 1 shows the results of the corrosion resistance tests of the products having the black chromate film obtained in above Examples 1 to 3 and Comparative Example 1 (the salt water spray test was conducted according to JIS 2371).

TABLE 1

| | Kind of plating | Ni content (%) | Plating thickness (μm) | Tint |
|---|---|---|---|---|
| Ex. 1 | Zn—Ni | 3 | 8 | uniform black |
| | " | 5 | " | " |
| | " | 7 | " | " |
| | " | 9 | " | " |
| | " | 12 | " | " |
| | " | 15 | " | black having interference color |
| Ex. 2 | Zn—Ni | 6 | 6 | uniform black |
| Ex. 3 | Zn—Ni | 8 | 10 | " |
| Comp. Ex. 1 | Zn | 0 | 8 | " |

| | Salt water spray test | |
|---|---|---|
| | Time taken for white rust formation (h) | Time taken for red rust formation (h) |
| Ex. 1 | at least 500 | at least 2000 |
| | " | " |
| | " | " |
| | " | " |
| | " | " |
| | " | " |
| Ex. 2 | " | " |
| Ex. 3 | " | " |
| Comp. Ex. 1 | 144 | 600 |

What is claimed is:

1. A black chromate solution which comprises 1 to 50 g/l of hexavalent chromium; 1 to 50 g/l of sulfate ion; 0.05 to 1.0 g/l of soluble silver; 0.5 to 100 g/l of a sulfonated carboxylic acid selected from the group consisting of sulfo-aromatic carboxylic acids having 7 to 15 carbon atoms, sulfonated aliphatic dicarboxylic acids having 3 to 10 carbon atoms and salts thereof; and a balance of water, the solution having a pH of 0.5 to 2.5.

2. The black chromate solution of claim 1, wherein said sulfonated carboxylic acid is used in an amount of 5 to 40 g/l.

3. A method of forming a black chromate film on a Zn-Ni alloy plating which comprises immersing the Zn-Ni alloy plating into a black chromate solution comprising 1 to 50 g/l of hexavalent chromium; 1 to 50 g/l of sulfate ion; 0.05 to 1.0 g/l of soluble silver; 0.5 to 100 g/l of a sulfonated carboxylic acid selected from the group consisting of sulfo-aromatic carboxylic acids having 7 to 15 carbon atoms, sulfonated aliphatic dicarboxylic acids having 3 to 10 carbon atoms and salts thereof; and a balance of water, the solution having a pH of 0.5 to 2.5, at a temperature of 15° to 50° C. for 30 to 300 seconds.

4. The method of claim 3 wherein the Zn-Ni alloy plating contains not more than 15% by weight of Ni.

5. The method of claim 3 wherein the Zn-Ni alloy plating contains 3 to 12% by weight of Ni.

6. The method of claim 3, wherein said sulfonated carboxylic acid is used in an amount of 5 to 40 g/l.

7. The method of claim 3, wherein the Zn-Ni alloy is immersed in the black chromate solution for 30 to 180 seconds to form a black chromate film having a thickness of 0.5 to 3 μm.

8. The method of claim 3, wherein the Zn-Ni alloy has a Ni deposition rate of 3 to 12% by weight.

* * * * *